US007441481B2

(12) United States Patent
Liu

(10) Patent No.: US 7,441,481 B2
(45) Date of Patent: Oct. 28, 2008

(54) SOCKET WRENCH HAVING MULTIPLE DRIVING HEADS

(76) Inventor: Yi-Feng Liu, No. 7, Lane 56, Zhongzheng Rd., Xinzhuang City, Taipei County (TW)

( * ) Notice: Subject to any disclaimer, the term of this patent is extended or adjusted under 35 U.S.C. 154(b) by 59 days.

(21) Appl. No.: 11/602,361

(22) Filed: Nov. 21, 2006

(65) Prior Publication Data

US 2008/0115631 A1 May 22, 2008

(51) Int. Cl.
*B25B 13/46* (2006.01)

(52) U.S. Cl. ..... 81/62; 81/124.4; 81/125.1; 81/439

(58) Field of Classification Search ..... 81/61, 81/62, 63.1, 177.1, 124.4, 125.1, 437–439; D8/25, 81, 83, 85
See application file for complete search history.

(56) References Cited

U.S. PATENT DOCUMENTS 1,620,262 A * 3/1927 Klaboe ..... 7/167
3,905,254 A * 9/1975 Palatnick et al. ..... 81/57.3
5,186,083 A * 2/1993 Hsiao ..... 81/124.4
5,365,811 A * 11/1994 Chi ..... 81/439
5,713,252 A * 2/1998 Iwinski et al. ..... 81/439
7,243,578 B2 * 7/2007 Burwell ..... 81/124.4
7,305,907 B2 * 12/2007 Burwell ..... 81/60

* cited by examiner

*Primary Examiner*—D. S Meislin
(74) *Attorney, Agent, or Firm*—Muncy, Geissler, Olds & Lowe PLLC

(57) ABSTRACT

A socket wrench having multiple driving heads includes a triangular star-shape handle which consists of an upper and a lower shell. The triangular portions of the handle have respectively a protrusive driving portion. Two neighboring driving portions are connected by a side wall formed in an arched shape concaved inwards. Each driving portion holds a driving bar having a coupling head on an outer side and a ratchet on an inner side inside. A clamping box is provided that includes an upper and a lower deck in the interior center of the handle and has three pairs of detent plates in the middle to control turning direction of the ratchet. A rotary knob is provided having an actuation bar beneath to move the detent plates. Thus a plurality of driving bars which hold the coupling heads of different shapes and sizes can be held in the handle. The socket wrench thus formed can be grasped easily and change of driving direction can be accomplished rapidly.

6 Claims, 7 Drawing Sheets

SOCKET WRENCH HAVING MULTIPLE DRIVING HEADS

FIELD OF THE INVENTION

The present invention relates to the handle of socket wrenches and particularly to a socket wrench that has a plurality of driving bars to drive sockets of different sizes and shapes.

BACKGROUND OF THE INVENTION

Referring to FIG. 1, a conventional T-shape socket wrench has a head 1 and a handle 2 running radially through two sides of the head 1 to be grasped by a user to exert forces. There is a square coupling portion 3 beneath the head 1. The coupling portion 3 has a housing cavity 4 on one side wall to hold a spring 5 and a steel ball 6. The steel ball 6 is jutting outwards under the elastic force of the spring 5 to be wedged in a socket (not shown in the drawing) of a matching profile. By turning the handle 2 the head 1 can drive the coupling portion 3 to turn the socket to drive a work piece (such as a bolt or nut) to rotate.

In practice the handle 2 runs through the head 1 on the left side and right side at a selected length. The handle 2 is fixedly fastened to the head 1 and cannot be removed. Hence a larger operation space is required to use the T-shape socket wrench. Carrying is not convenient and practicality suffers.

Moreover, using a T-shape socket wrench to drive a socket of one specification in dimension is not economic effective.

SUMMARY OF THE INVENTION

In view of the disadvantages occurred to the conventional socket wrenches, the primary object of the present invention is to provide a socket wrench that is capable of driving multiple sockets. It includes a triangular star-shaped handle which consists of an upper shell and a lower shell that are coupled together. The handle has triangular portions each holds a protrusive driving portion. Two neighboring driving portions are connected by a side wall formed in an arched shape concaved inwards. Each driving portion clamps a driving bar inside. The driving bar has a coupling head on an outer side and a ratchet gear on an inner side. The handle further has a clamping box located in the center of the interior thereof that consists of an upper deck and a lower deck. The clamping box has three pairs of detent plates in the middle. The detent plates press the ratchet gear to control rotation thereof. A rotary knob is provided, and an actuation bar is provided beneath the rotary knob to control rotational direction of the detent plates to allow the ratchet gear to rotate in one direction. Thus the handle can hold multiple driving bars with sockets of different sizes and shapes coupled thereon. The socket wrench thus constructed can be grasped easily and change the driving direction quickly.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
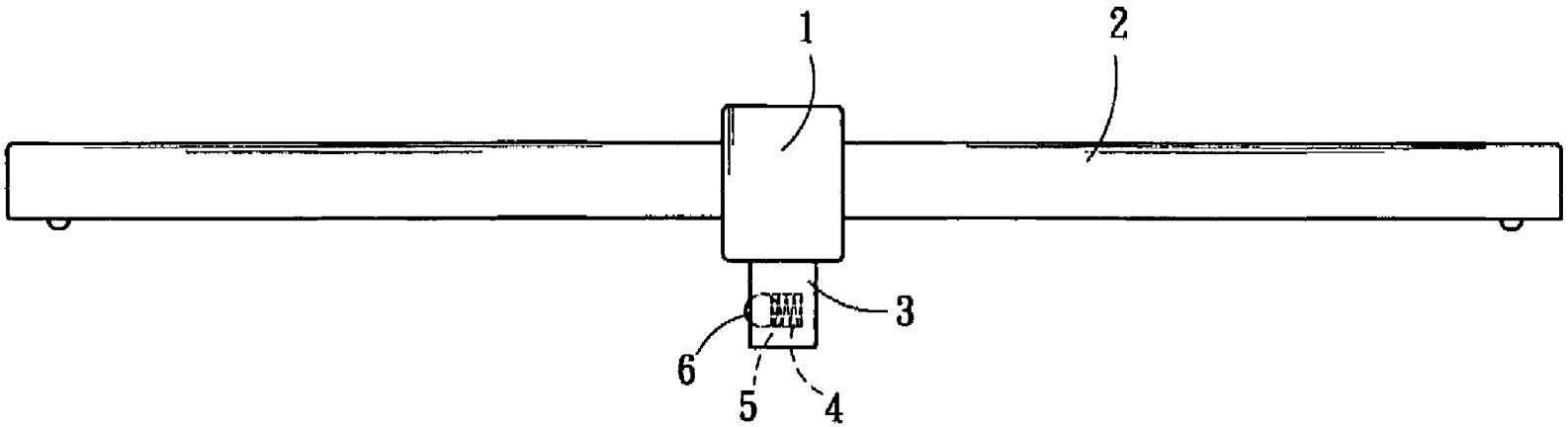
Fig. 1 PRIOR ART
FIG. 1 is a schematic view of a conventional T-shape socket wrench.
Figure 2:
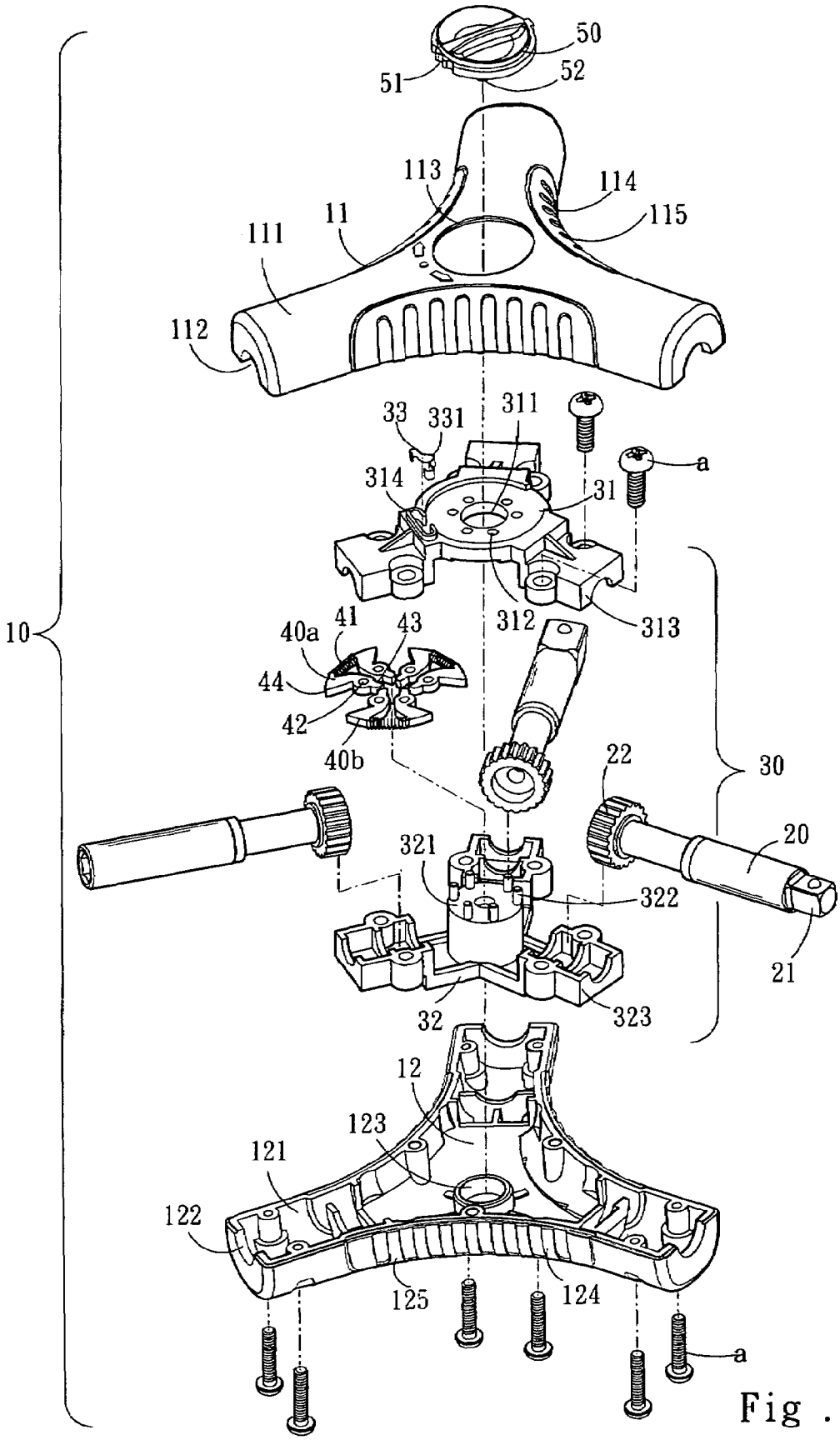
FIG. 2 is an exploded view of an embodiment of the invention.
Figure 3A:
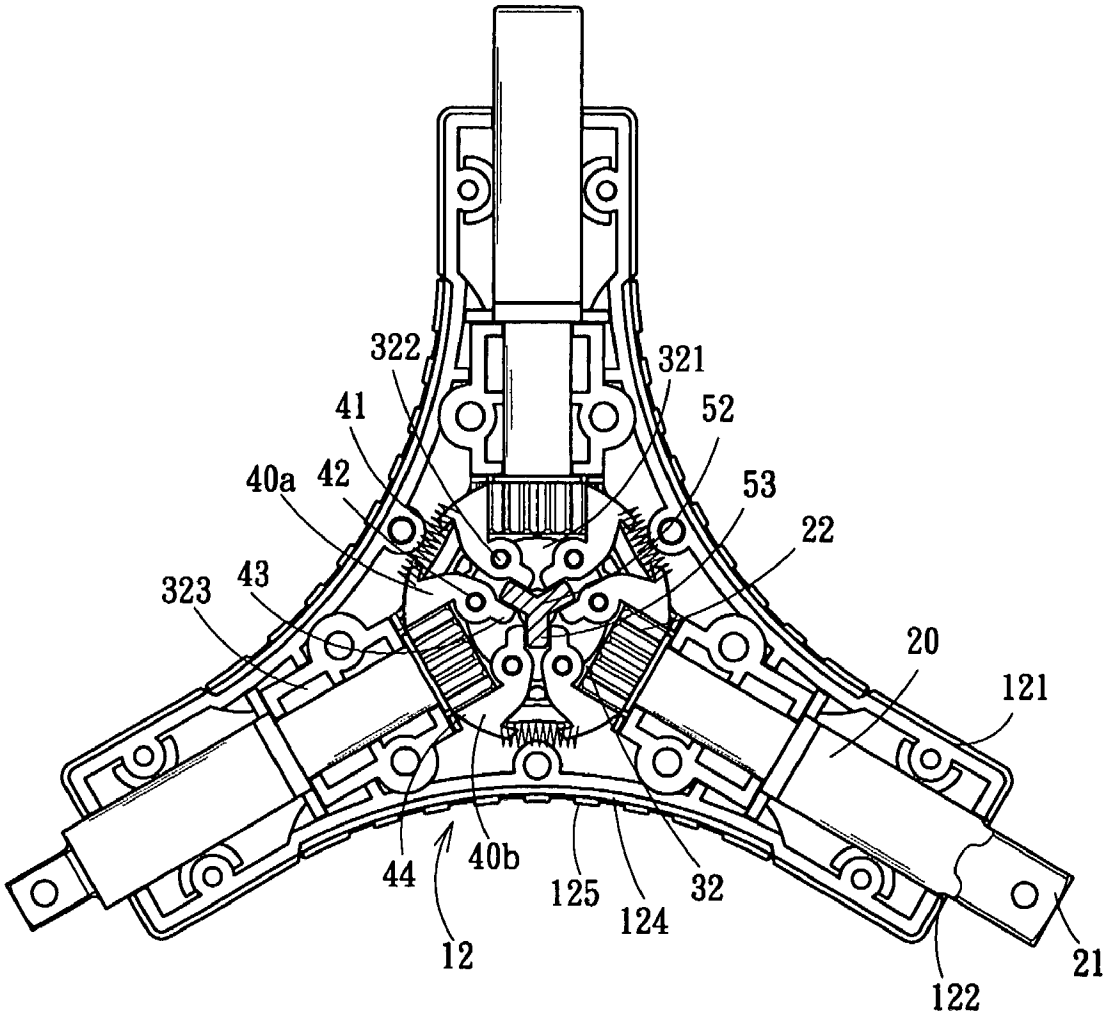
FIG. 3A is a plane view of an embodiment of the invention.

Please referring to FIGS. 2 and 3A, the socket wrench having multiple driving heads of the invention includes a triangular star-shape handle 10 which consists of an upper shell 11 and a lower shell 12 that are coupled together.

The lower shell 12 has an upward opening. Each of the triangular portions has a lower semi-circular shell strut 121 which has a lower semi-circular trough 122 on an Outer end. The lower shell 12 also has a retaining ring 123 in the center of the interior, and three lower side walls 124 each is formed in an arched shape concaved inwards. Each of the lower side walls 124 has a lower slipping-resistant trace 125. The trace is a cushion or pad used as a holding surface for the operator's hand.

The upper shell 11 has a downward opening. Each of the triangular portions has an upper semi-circular shell strut 111 which is coupled with the lower semi-circular shell strut 121 to jointly form a driving portion in the shape of a circular bar. The upper semi-circular shell strut 111 has an upper semi-circular trough 112 on an outer end to be coupled with the lower semi-circular trough 122 of the lower shell 12 to form a circular opening. The upper shell 11 further has a circular opening 113 in the center of the top. The upper shell 11 has three upper side walls 114 each is formed in an arched shape concaved inwards. Each of the side walls 114 has an upper slipping-resistant trace 115 corresponding to the lower slipping-resistant trace 125 of the lower shell 12. The lower semi-circular shell strut 121 can receive a fastening element (such as screw) a to fasten to the upper semi-circular strut 111 of the upper shell 11.

There are three circular driving bars 20 each has a square strut type coupling head 21 on an outer side (or a square cavity formed inside) and a ratchet 22 on an inner side.

There is also a clamping box 30 located in the center of the handle 10 that includes an upper deck 31 and a lower deck 32 coupling together. The lower deck 32 has a circular anchor portion 321 in the center that has a plurality anchor struts 322 on the top, and a lower trough seat 323 located in the direction of the semi-circular shell troughs 111 and 121 of the upper and lower shells 11 and 12.

The upper deck 31 has an opening 311 in the center surrounding by a plurality of apertures 312, and an upper trough seat 313 located in the direction of the semi-circular shell troughs 111 and 121 of the upper and lower shells 11 and 12. The upper trough seat 313 and the lower trough seat 323 jointly couple the driving bar 20 with the coupling head 21 extending outside. One of the upper trough seats 313 has a retaining trough 314 on the top that has an opening facing the center.

Figure 4:
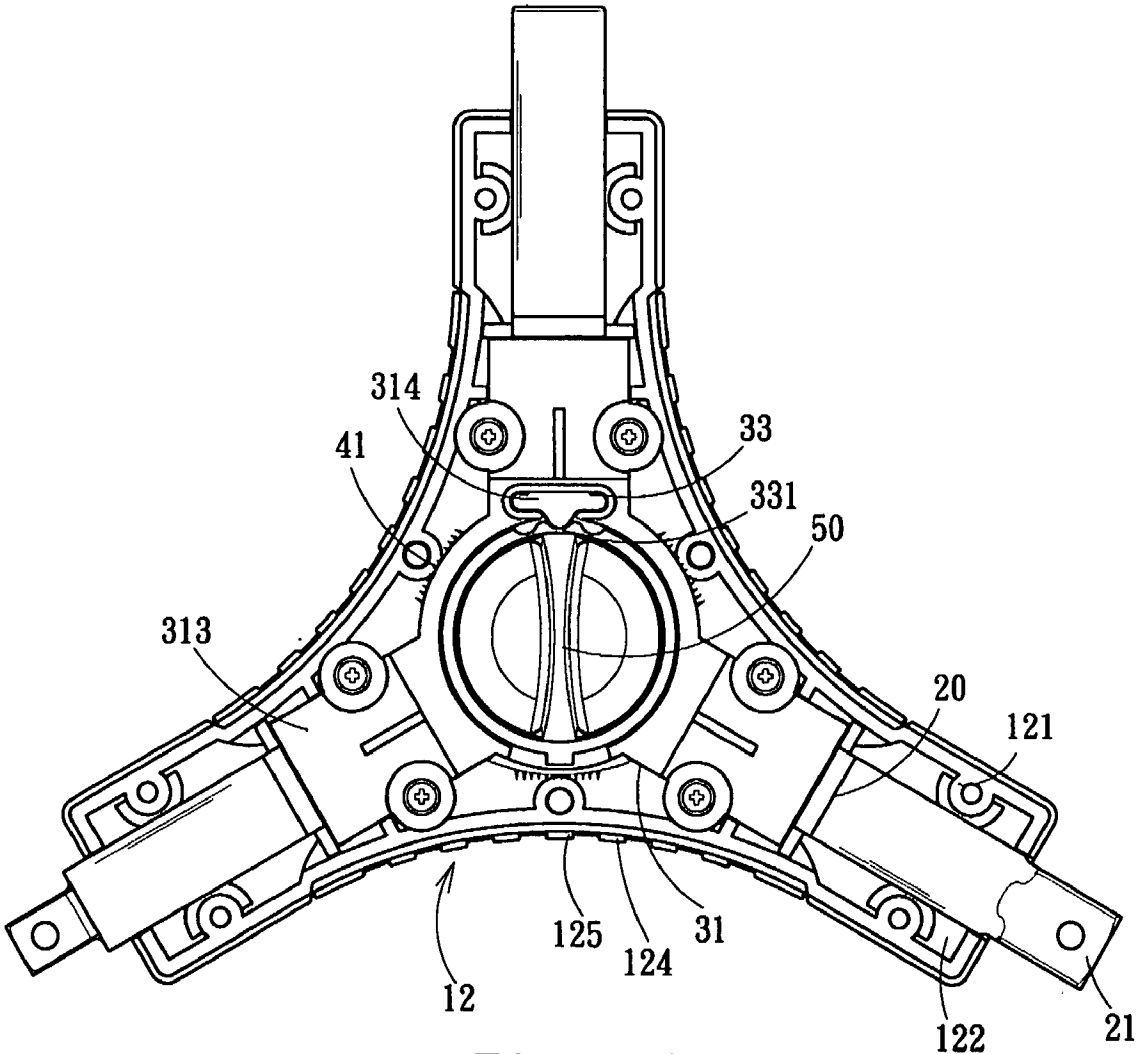
FIG. 4 is a top view of an embodiment of the invention.

An elastic latch member 33 is provided and made by folding an elastic reed with a brake portion 331 bulging in the center. The elastic latch member 33 is wedged in the retaining trough 314 with the brake portion 331 extending outside the opening thereof as shown in FIG. 4.

Three pairs of detent plates 40*a* and 40*b* are provided and formed in a circular manner. Each pair of the detent plates 40*a* and 40*b* hold the ratchet 22 in the middle. Two neighboring detent plates 40*a* and 40*b* clamp an extensible elastic member (such as a spring) 41 between them. The detent plates 40*a* and 40*b* further have an aperture 42 close to the center. An actuation end 43 is formed on an inner side relative to the aperture 42. The detent plates 40*a* and 40*b* further have respectively a brake tooth 44 on an opposite side remote from the elastic member 41. The brake tooth 44 may be wedged in a tooth groove of two teeth of the ratchet 22.

There is a round rotary knob 50 located in the circular opening 113 of the upper shell 11. The rotary knob 50 has three indented teeth 51 on the periphery, and an actuation bar 52 located beneath thereof. The actuation bar 52 has three radial jutting wings 53.

By means of the aforesaid structure, for assembly the lower deck 32 of the clamping box 30 is mounted onto the retaining ring 123 of the lower shell 12 and anchored thereon. The three lower trough seats 323 of the lower deck 32 is held in the lower semi-circular shell struts 121, and the driving bars 20 are placed in the lower trough seats 323. The three pairs of detent plates 40*a* and 40*b* are mounted onto the anchor portion 321 of the lower deck 32 with the anchor struts 322 running through the apertures 42 of the detent plates 40*a* and 40*b*. Then the upper deck 31 is placed above the detent plates 40*a* and 40*b* with the anchor struts 322 running through the apertures 312 of the upper deck 31 so that the upper deck 31 and the lower deck 32 are aligned with each other. The upper shell seat 313 can receive a pair of fastening element (such as screws) a from the upper side to fasten to the lower trough seat 323 to fasten the upper deck 31 and the lower deck 32 together.

Figure 5:
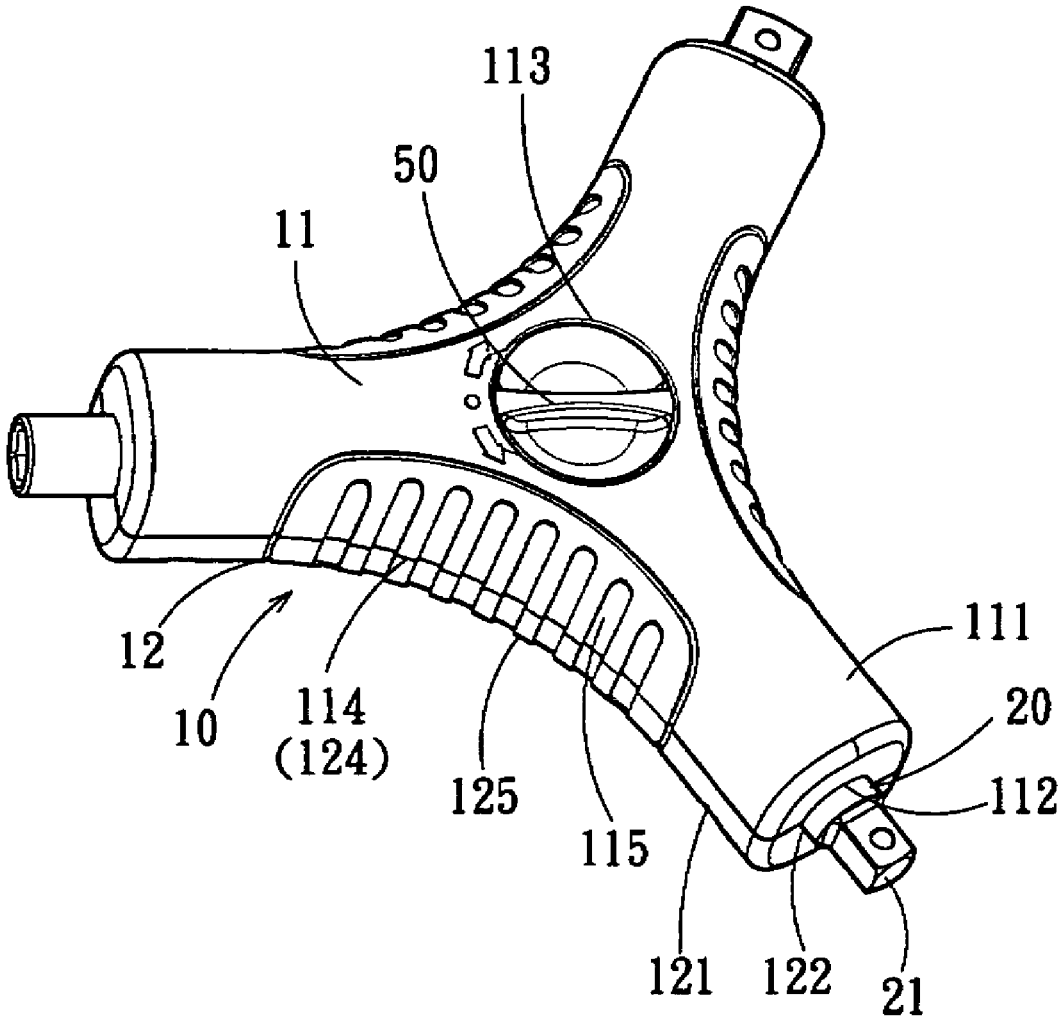
FIG. 5 is a perspective view of an embodiment of the invention.

The rotary knob 50 is placed in the circular opening 113 of the upper shell 11 from above such that the actuation bar 52 is positioned in the center of the three pairs of detent plates 40*a* and 40*b*. The lower shell 12 is fastened to the upper shell 11 through six pieces of fastening elements a from below to fasten the upper shell 11 and the lower shell 12 together as shown in FIG. 5. The coupling head 21 of each driving bar 20 is exposed outside through an opening formed by coupling the semi-circular troughs 112 and 122 of the upper shell 11 and the lower shell 12.

When in use, the square coupling head 21 of the driving bar 20 is coupled with a square cavity of a socket (not shown in the drawings). The handle 10 can be turned to drive the socket to rotate to fasten or unfasten a bolt (or nut).

The rotary knob 50 can drive the actuation bar 52 below to make the three jutting wings 53 to rotate in the positive and reverse direction. When the rotary knob 50 is turned, and the brake portion 331 of the elastic latch member 33 is engaged with the middle indented teeth 51 of the rotary knob 50, referring to FIGS. 3A and 4, the three jutting wings 53 can stop the actuation end 43 of the detent plates 40*a* and 40*b* so that the brake tooth 44 is engaged with the ratchet 22 to stop the driving bar 20 from rotating. Meanwhile turning the handle 10 can move the driving bar 20 to drive the socket to turn in the positive or reverse direction.

Figure 3B:
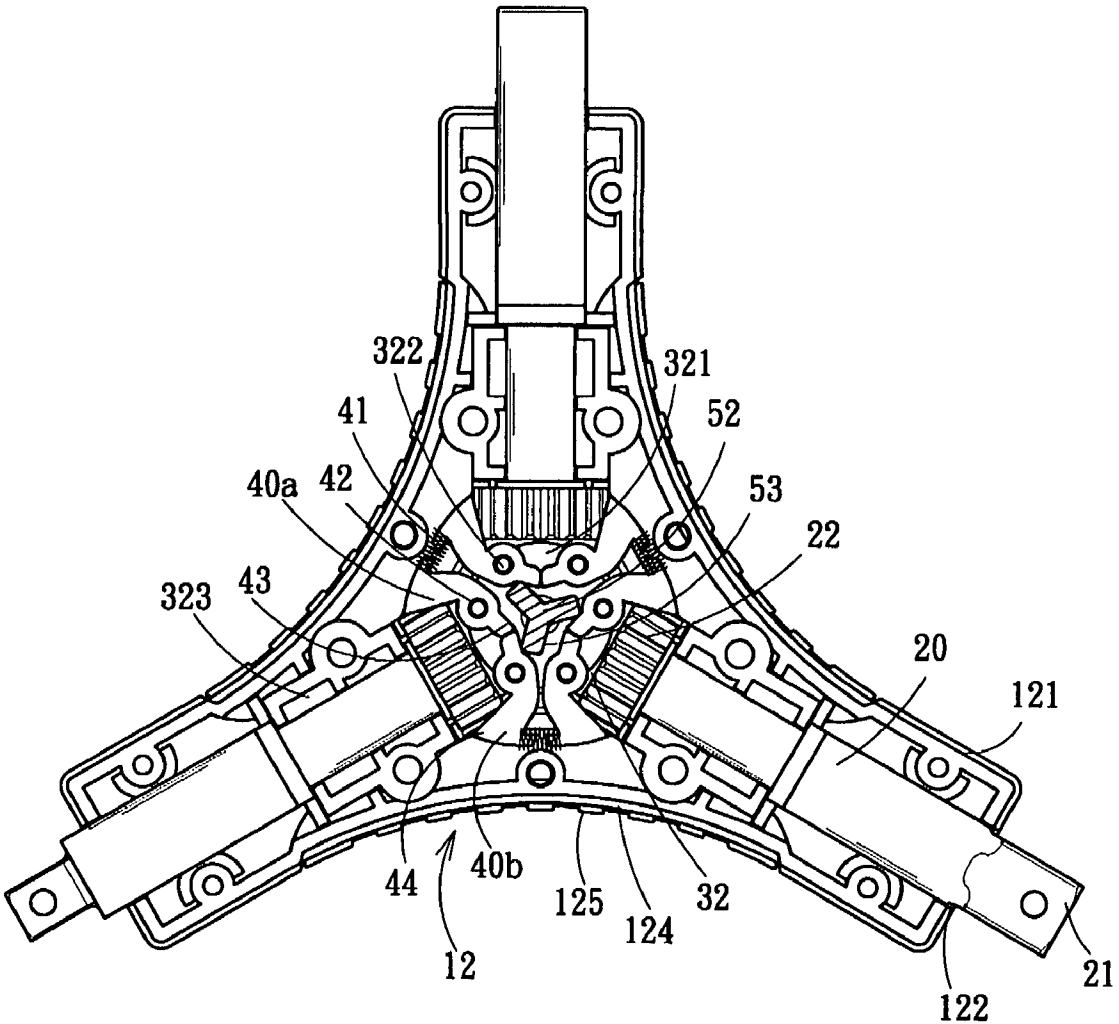
FIG. 3B is a schematic view according to FIG. 3A in an operating condition.

Referring to FIGS. 3B and 4, when the rotary knob 50 is turned clockwise, and the brake portion 331 of the elastic latch member 33 is engaged with the indented teeth 51 on the left side, the three jutting wings 53 can rotate synchronously, and the actuation end 43 of the three detent plates 40*b* is stopped. The brake tooth 44 of the detent plate 44*b* escapes the ratchet 22, and another detent plate 40*a* is engaged with the ratchet 22 so that the ratchet 22 can rotate counterclockwise, but not clockwise. Hence the socket can be driven to rotate in one direction clockwise, but rotate idly counterclockwise.

Figure 3C:
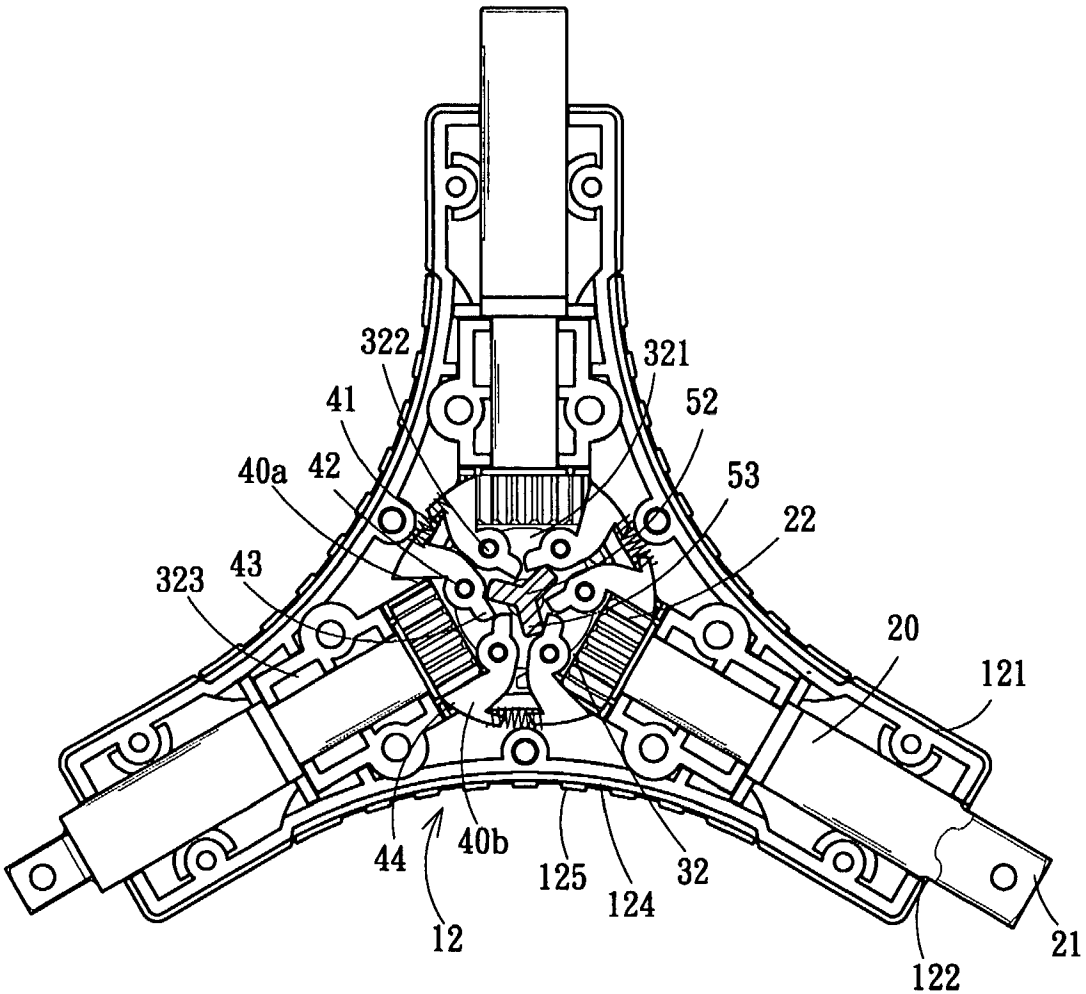
FIG. 3C is a schematic view according to FIG. 3A in another operating condition.

When the rotary knob 50 rotates counterclockwise, the brake portion 331 of the elastic latch member 33 latches on the indented teeth 51 on the right side. Referring to FIGS. 3C and 4, the three jutting wings 53 are rotated synchronously, and the actuation end 43 of the three detent plates 40*a* is stopped. The brake tooth 44 of the detent plate 44*a* escapes the ratchet 22, and another detent plate 40*b* is engaged with the ratchet 22 so that the ratchet 22 can rotate clockwise, but not counterclockwise. Hence the socket can be driven to rotate in one direction counterclockwise. In short, when in use, by turning the rotary knob 50 the socket can be driven to rotate either in the positive or reverse direction. Change of direction can be done simply and rapidly.

As the coupling head 21 of the driving bar 20 can be formed in different shapes (such as square strut or square cavity) and dimensions to match different shapes and sizes of sockets, users can couple the frequently used sockets in advance with the semi-circular shell struts 111 and 121 in three different directions of the handle 10. When there is a need for replacement, unfasten the fastening elements a at the bottom of the lower shell 11, the upper shell 11 can be removed, and the fastening elements a on the upper deck 31 can be removed also, then the upper deck 31 can be removed to change the coupling head 21 of different shapes and sizes on the driving bar 20.

It is to be noted that the handle 10 of the invention adopts the design of triangular star shape with the driving bar 20 in any direction to drive a socket, while the two other semi-circular shell struts 111 and 121 and the side walls 114 and 124 in the middle can be held by user's palm. With the aid of the slipping-resistant traces 115 and 125 on the side walls 114 and 124, the handle can be turned by a force without slipping. It is an ergonomic design and makes grasping and turning of the handle easier.

What is claimed is:

1. A socket wrench having multiple driving heads, comprising:

a handle which has an upper shell and a lower shell corresponding to each other and triangular portions each having a protrusive driving portion, two neighboring driving portions being connected by a side wall formed in an arched shape concaved inwards;

three driving bars, each of which is located in a corresponding one of three driving portions and has a coupling head on an outer side and a ratchet on an inner side, each coupling head being located outside the corresponding driving portion;

a clamping box which is located in the center of the handle and has three pairs of detent plates pivotally coupled thereon, each pair of the detent plates holding the ratchet in a middle portion thereof, two neighboring detent plates clamping an elastic member, each detent plate having a brake tooth engageable with the ratchet; and a round rotary knob which is located on the top of the handle and has an actuation bar located thereunder, the actuation bar having three radial jutting wings to turn the detent plates.

2. The socket wrench of claim 1, wherein the triangular portions of the upper and lower shells have respectively a semi-circular shell strut which has a semi-circular trough on an outer end, the two semi-circular troughs jointly forming an opening to allow the coupling head to be extended outside therethrough.

3. The socket wrench of claim 2, wherein the clamping box includes an upper deck and a lower deck that have respectively an upper trough seat and a lower trough seat in the direction of the semi-circular shell strut, the upper and lower trough seats holding the driving bar, the upper trough seat having a retaining trough which has an opening facing the center, the retaining trough holding an elastic latch member which has a bulged brake portion in the middle extending outside the opening of the retaining trough, the rotary knob having three indented teeth latchable with the brake portion.

4. The socket wrench of claim 1, wherein the side walls of the upper shell and the lower shell have respectively a slipping-resistant pad corresponding to each other.

5. The socket wrench of claim 3, wherein the upper trough seat has a plurality of fastening elements which are fastened to the lower trough seat in a downward direction, the lower deck having an anchor portion in the center that has a plurality of anchor struts on the top surface thereof, the detent plates having apertures running through by the anchor struts and an actuation end on an inner side of the apertures to be moved by the three jutting wings of the actuation bar.

6. The socket wrench of claim 2, wherein the semi-circular shell strut of the lower shell is run through upwards by a pair of fastening elements to fasten to the semi-circular shell strut of the upper shell.

* * * * *